US005756277A

United States Patent [19]

Sano

[11] Patent Number: 5,756,277

[45] Date of Patent: May 26, 1998

[54] METHOD FOR PRODUCING SILVER HALIDE EMULSION

[75] Inventor: Toru Sano, Kanagawa, Japan

[73] Assignee: Fuji Photo Film Co., Ltd., Kanagawa, Japan

[21] Appl. No.: 580,188

[22] Filed: Dec. 28, 1995

[30] Foreign Application Priority Data

Jan. 5, 1995 [JP] Japan ..... 7-015483

[51] Int. Cl.[6] ..... G03C 1/015; G03C 1/035; G03C 1/07

[52] U.S. Cl. ..... 430/569; 430/567

[58] Field of Search ..... 430/569, 567

[56] References Cited

U.S. PATENT DOCUMENTS

| | | | |
|---|---|---|---|
| 4,400,463 | 8/1983 | Maskasky | 430/434 |
| 4,804,621 | 2/1989 | Tufano et al. | 430/567 |
| 5,252,452 | 10/1993 | Chang et al. | 430/569 |
| 5,286,621 | 2/1994 | Verbeeck | 430/569 |
| 5,298,387 | 3/1994 | Maskasky | 430/569 |
| 5,298,388 | 3/1994 | Maskasky | 430/569 |
| 5,310,644 | 5/1994 | Delton | 430/569 |
| 5,399,478 | 3/1995 | Maskasky | 430/569 |
| 5,411,852 | 5/1995 | Maskasky | 430/569 |

FOREIGN PATENT DOCUMENTS 0 645 671 A1 3/1995 European Pat. Off. ..... G03C 1/035

*Primary Examiner*—Mark F. Huff

*Attorney, Agent, or Firm*—Sughrue, Mion, Zinn, Macpeak & Seas, PLLC

[57] ABSTRACT

A method for producing a silver halide emulsion comprising high silver chloride tabular grains each having a chloride content of 50 mol % or more and having a major plane comprising a (111) face, which comprises a step for conducting nucleation of said grains substantially in the absence of a crystal phase controlling agent to form grains which have two twin planes parallel with each other and of which most of the surface are (100) faces, a step for ripening said grains by adding a crystal phase controlling agent which adsorbs to the (111) face or a mixture of a crystal phase controlling agent which adsorbs to the (111) face and a protective colloid to reduce the ratio of grains other than the grains having two or more parallel twin planes and then a step for growing with remaining tabular grains having a major plane mainly comprising a (111) face to form tabular grains having a major plane comprising a (111) face.

4 Claims, 5 Drawing Sheets

METHOD FOR PRODUCING SILVER HALIDE EMULSION

FIELD OF THE INVENTION

The present invention relates to a method for producing a photographic silver halide emulsion, more specifically, it relates to a method for producing a high silver chloride tabular grain emulsion at least having a chloride content of 50 mol % or more and having a major plane comprising a (111) face.

BACKGROUND OF THE INVENTION

A silver halide grain having a high silver chloride content (hereinafter referred to as a "high silver chloride grain") may be a cubic or tabular grain having a major plane of a (100) face. It has been shown that the tabular grain, of which major plane is a (111) face, always has two parallel twin planes irrespective of the halogen composition. It has been very difficult to formulate a high silver chloride grain whereby either cubic or tabular having a plane of a (100) face, having no twin plane, is converted into a tabular grain having two parallel twin planes having a major plane comprising a (111) face.

However, a method for conducting formation of a twin plane and formation of a (111) face simultaneously to obtain a tabular grain having a major plane mainly comprising a (111) face has been proposed, where the grain formation is conducted in the presence of a crystal phase controlling agent (sometimes called a crystal habit controlling agent or a growth modifier), and this technique is described, for example, in the following patents:

1. U.S. Pat. No. 4,399,215

A method where the grain formation of a high silver chloride tabular grain having a silver chloride content of 50 mol % or more is conducted by eliminating a bromide and an iodide from the inside of the grain, while keeping the pAg and the pH of from 6.5 to 10 and from 8 to 10, respectively, and in the presence of ammonia.

2. U.S. Pat. No. 4,400,463

A method where the grain formation is conducted in the presence of a peptizer having an aminoazaindene and a thioether group.

3. JP-A-62-218959 (the term "JP-A" as used herein means an "unexamined published Japanese patent application")

A method where the grain formation is conducted in the presence of a thiourea-based compound.

4. JP-A-62-163046

A method where the grain formation is conducted at a chlorine ion concentration of at least 0.5 mol using gelatin having a methionine content of less than 30 μmol/g.

5. JP-A-64-70741

A method where the grain formation is conducted in the presence of a sensitizing dye.

6. JP-A-1-155332

A method where the grain formation is conducted in the presence of a compound described in the specification.

7. JP-A-2-32

A method where the grain formation is conducted in the presence of a compound described in the specification.

8. JP-A-6-11787

A method where the grain formation is conducted using a high methionine gelatin having a methionine content in excess of 30 μmol/g in a dispersion medium having a pH of at least 4.5 and a chlorine ion concentration in excess of 0.5 mol and containing 4,6-di(hydroamino)-5-aminopyrimidine.

9. U.S. Pat. No. 4,804,621

A method where the grain formation is conducted in the presence of a compound described in the specification.

However, in all of these patents, the (111) face formation and the twin plane formation are accomplished with a help of a controlling agent by letting the crystal phase controlling agent be present already at the nucleation stage. JP-A-6-11787 (No. 8 above) sets forth an example where the crystal phase controlling agent was added after nucleation, but according to the description in the text thereof, this is to avoid interaction (formation of silver salt) between silver and a crystal phase controlling agent such as adenine at the nucleation and the twin plane formation is conducted by the addition of a crystal phase controlling agent (growth modifier), and in addition, the nucleation conditions such as the chlorine ion concentration are greatly different from those of the present invention, thus, the patent publication altogether differs from the present invention in the way of thinking on the twin crystal formation. Further, the tabular grain prepared in the methods described in the patent publications 1 to 9 above is polydispersed as compared with the well known silver bromide- or silver iodobromide-type tabular grain and moreover, single twin grains having one twin plane, multiple twin grains having non-parallel two or more twin planes and regular crystal grains having no twin plane are mixed therein, in which the proportion of tabular grains of which main plane having parallel two twin planes is a (111) face is low. Further, it is difficult to selectively form these grains by the conventional methods which allow the incorporation of a crystal phase controlling agent at the nucleation time.

SUMMARY OF THE INVENTION

The object of the present invention is to provide a method for producing high silver chloride tabular grains having a major plane mainly comprising a (111) face, almost free of the presence of a non-parallel twin grain and being very monodispersed, based on the way of thinking completely different from the conventional one.

In the present invention, the twin crystal formation is conducted in the absolute absence of a silver halide solvent of a crystal phase controlling agent (called a growth modifier or a crystal habit controlling agent) at the nucleation time and then a tabular grain having a major plane mainly comprising a (111) face and-having two parallel twin planes is grown by adding a crystal phase controlling agent. Based on this way of thinking perfectly novel over the conventional techniques, high silver chloride tabular grains each having a major plane comprising a (111) face can be prepared, which scarcely contains non-parallel twin grains and are very monodispersed.

More specifically, the present invention provides:

(1) A method for producing a silver halide emulsion comprising high silver chloride tabular grains each having a chloride content of 50 mol % or more and having a major plane comprising a (111) face, which comprises a step for conducting nucleation of the grains substantially in the absence of a crystal phase controlling agent to form grains which have two twin planes parallel with each other and of which most of the surface are (100) faces, a step for ripening the grains by adding a crystal phase controlling agent which adsorbs to the (111) face or a mixture of a crystal phase controlling agent which adsorbs to the (111) face and a protective colloid to reduce the ratio of grains other than the grains having two or more parallel twin planes and then a step for growing with remaining tabular grains having a major plane mainly comprising a (111) face to form tabular grains having a major plane comprising a (111) face;

(2) The method for producing a silver halide emulsion as described in item (1), wherein the nucleation is conducted in the absence of a crystal phase controlling agent and at an excess chlorine ion concentration of from $1\times10^{-4}$ to $8\times10^{-2}$ mol/l.

(3) The method for producing a silver halide emulsion as described in item (1), wherein the nucleation is conducted substantially in the absence of a silver halide solvent (preferably is conducted in the presence of not more than $10^{-6}$ mol/mol-Ag of a silver halide solvent and particularly preferably is conducted in the absence of silver halide solvent); and (4) The method for producing a silver halide emulsion as described in item (1) or (2), wherein the nucleation is conducted using from 0.05 to 8 g/l of a protective colloid.

DETAILED DESCRIPTION OF THE INVENTION

Figure 1:
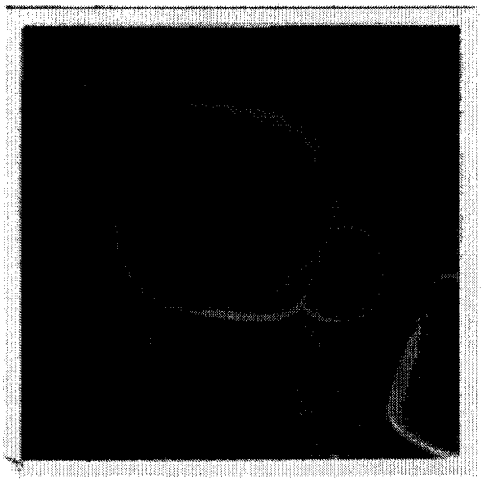
FIG. 1 is an SEM photograph of a twin cubic grain.

The constitutional elements of the present invention are described below in detail.

1. Protective Colloid

Gelatin is effective as a protective colloid for use at the nucleation time in the present invention. Examples of the gelatin include an alkali-processed gelatin, an acid-processed gelatin and a gelatin derivative such as acetylated gelatin and a phthalated gelatin. Among these, an alkali-processed gelatin using a beef bone as a raw material is effective. As the gelatin for use in nucleation, a high molecular weight gelatin having a molecular weight of 30,000 or more, preferably 50,000 or more is effective. In the formation of a high silver chloride grain, a so-called low molecular weight gelatin having a molecular weight of around 10,000 may be used but the use accompanies difficulties because non-parallel twin grains are readily formed. However, as the chloride content becomes lower within the range of the present invention, the above-described low molecular weight gelatin may also be effectively used.

Examples of other protective colloid which can be used in the present invention include natural products such as agar, starch, dextran and silk fibroin, and synthetic protective colloids such as a homopolymer or copolymer having acrylamide, amino group, vinyl alcohol, acrylic acid, hydroxyquinoline, vinylpyrrolidone, styrene, vinylimidazole, azaindene, thioether or pyridine group as a functional group.

These protective colloids can be selected variously within the range that the grain size is not extremely increased at the nucleation time and a large number of non-parallel twin grains are not formed.

The protective colloid is used at the nucleation in an amount of preferably from 0.05 to 8 g/l, more preferably 0.08 to 7 g/l and most preferably 0.3 to 5 g/l. Although it depends upon the addition rate of a silver nitrate solution or the pAg at the nucleation, if the amount of protective colloid is less than the above-described range, non-parallel twin grains are readily generated, whereas if the amount exceeds the range, objective twin grains are generated in a small number and at the subsequent ripening, the grain may grow into a very large-sized tabular grain, regular crystal grains having no twin plane may remain and moreover, almost all grains formed may be a regular crystal grain. The amount of gelatin at the nucleation is very important factor as well as the chlorine ion concentration which will be described later. It is usually preferred to previously add the protective colloid for use in the nucleation as an aqueous solution having dissolved therein the gelatin to a reaction solution before the addition of a silver salt solution. Also, a method where the protective colloid is dissolved in a silver salt solution or a halogen solution within the above-described amount range and then added or a method where it is added in the state of a solution or solid at the addition time of a silver salt solution or a halogen solution may be used and these methods may be selected depending upon the purpose or used in combination.

It is effective in the present invention to add, after the completion of nucleation, additional protective colloid at the same time with or before or after the addition of a crystal phase controlling agent. The additional protective colloid can be freely selected from the above-described colloids and it may be the same with or different from the protective colloid used at the nucleation. Further, either one kind or two or more kinds of colloids may be freely selected according to the purpose. The additional protective colloid may be added at any time in the period of from immediately after the completion of nucleation to immediately before the completion of grain formation or may be added either at once or in installments, but in a preferred embodiment, the additional protective colloid is added at the same time with a crystal phase controlling agent, added as a mixture with a crystal phase controlling agent in the state of a solution or solid, or added after the completion of ripening following the addition of a crystal phase controlling agent but before the growth of grains.

The excess chlorine ion concentration at the time of nucleation is another important factor of the present invention. The excess chlorine ion concentration as used herein means that the chlorine ion concentration is excessive to the silver amount in a silver salt solution added at the nucleation. The amount of chlorine ions present at the nucleation time is a molar number calculated from (the molar number of silver ions added+the molar number of chlorine ions within the range of the present invention) and it should be noted here that the amount of chlorine ions in the reaction solution to the molar number of silver ions added also on the way of reaction is such that (the molar number of silver ions+the molar number of chlorine ions within the range of the present invention). In the present invention, the excess chlorine ion concentration to the molar number of silver ions used in the nucleation is from $1\times10^{-4}$ to $8\times10^{-2}$ mol/l, preferably from $5\times10^{-4}$ to $4\times10^{-2}$ mol/l, more preferably from $5\times10^{-4}$ to $2\times10^{-2}$ mol/l. The silver potential at the nucleation may be changed during the nucleation as long as it falls within the range of the present invention but preferably it is kept constant. The nucleation by a control double jet method is effective depending upon the case. The nucleation is conducted at an excess chlorine ion concentration in the above-described range because of two reasons. One reason is that if the concentration exceeds the range, the proportion of non-parallel twin grains increases to thereby reduce the production probability of desired grains and the second reason is that the grain intended to form at the nucleation in the method of the present invention is a grain of which plane has two twin planes parallel with each other and is a (100) face and it is necessary to convert the grain into a grain having a plane of a (111) face while eliminating grains other than the desired grain, for example, grains having no twin plane, at the ripening process. It is understood that the thickness of the (111) face grain, namely, the tabular grain of the present invention, is greatly dependent on the size of the grain of which plane has two parallel twin planes and is a (100) face (for the convenience, this grain is hereinafter called a twin cube) formed by the nucleation (see FIG. 1). The thickness of the tabular grain cannot be smaller than the thickness calculated from the twin cube grain formed by the nucleation. Accordingly, the size of the twin cube at the nucleation needs to be reduced as much as possible. When the nucleation is conducted in a simplest system only using a protective colloid, a chloride and a silver salt solution, it must be conducted at a low solubility region as much as possible. In particular, for obtaining tabular grains having a small thickness as can be easily obtained from silver bromide, it is a very important factor to conduct the nucleation at a low solubility region and preferably, the nucleation is conducted in the absence of an excess amount of a halide solvent such as ammonia or thioether.

Once the nucleation is completed, the excess halogen concentration during the subsequent ripening and grain growth may be freely selected depending upon the purpose.

It is advantageous to add a compound which reduces the solubility of silver halide at the nucleation and the solubility may also be reduced by selecting the protective colloid. However, if the excess chlorine ion concentration exceeds the range of the present invention, the addition of a compound which reduces the solubility is limited in its effect and a twin cube nucleus smaller in size than that of the present invention never be formed. This is a reason why a silver halide solvent such as ammonia or a thioether-based compound is not used in an excessive amount or thoroughly not used. However, during the ripening or growth step after the nucleation, the silver halide solvent may be variously selected and used according to the purpose.

The temperature at the nucleation is also important in the present invention. In order to form a nucleus as small as possible, the nucleation is preferably conducted at a low temperature as much as possible. More specifically, the temperature is usually from 15° to 45° C., preferably from 20° to 40° C., more preferably from 25° to 40° C. After the completion of nucleation, a crystal phase controlling agent which adsorbs to the (111) face or a crystal phase controlling agent which adsorbs to the (111) face and a protective colloid is (are) added and the temperature is raised to further grow the grain to achieve a grain size according to the purpose. After increasing the temperature, the temperature at the grain growth is sufficient if it is higher than the temperature at the nucleation but more specifically, it is from 20° to 95° C., preferably from 25° to 85° C., more preferably from 25° to 80° C.

The pH at the nucleation may be such a pH that causes no fogging of a silver halide grain itself, but the pH is preferably from 1 to 10, more preferably from 3 to 9. After the nucleation, the pH at the nucleation may be maintained but in the case when a crystal phase controlling agent of which adsorption is greatly affected by the pH is used, the pH may be freely changed within the range such that the adsorption can proceed and the silver halide grain is not fogged.

In the present invention, a crystal phase controlling agent is added after the nucleation so as to obtain a (111) face. The crystal phase controlling agent may be any compound which can adsorb to the grain to give the (111) face and further it is effective in the present invention to add two or more kinds of crystal phase controlling agents simultaneously or in installments according to the purpose at any time if it is after the completion of nucleation. Examples of the compound which is effective in the present invention are described below, but as stated above, any compound which can adsorb to the grain to give the (111) face can be used and thus, in achieving the effect, the present invention is by no means limited to these compounds. (Compounds described in the following patent publications are crystal phase controlling agents effective in the present invention.)

U.S. Pat. Nos. 4,399,215, 4,414,306, 4,400,463 and 4,713,323, JP-A-62-163046, JP-A-59-162540, U.S. Pat. Nos. 4,942,120, 5,061,617, 5,185,239, 5,178,997, 5,178,998, 5,176,992, 5,183,732 and 4,804,621, JP-B-55-42737 (the term "JP-B" as used herein means an "examined Japanese patent publication"), EP 0532801A1, EP 0481133A1, JP-A-62-218959, JP-A-63-213836, JP-A-63-218938, JPA-63-293536, JP-A-3-116113, JP-A-2-32, JP-A-3-212639, JP-A-4-283742, JP-A-4-335632, JP-A-3-137632, JP-A-3-252649, JP-A-3-127045, JP-A-63-2043, JP-A-62-299961, JP-A-63-41845, JP-A-3-288143, JP-A-4-161947, JP-A-64-70741, JP-A-64-79744, JP-A-1-155332, JP-A-1-159646, JP-A-1-250943, JP-A-2-43535, JP-A-4-6546, U.S. Pat. No. 4,783,398, JP-A-63-25643, EP-0534325A, JP-B-5-12696, U.S. Pat. Nos. 5,176,991 and 4,804,621, JP-A-6-11787, U.S. Pat. No. 5,250,408 and JP-A-1-102453.

Specific examples of the compounds are set forth below.

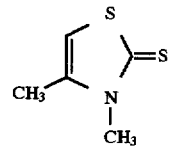

I-(1)

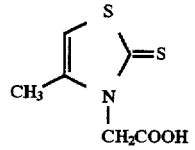

I-(2)

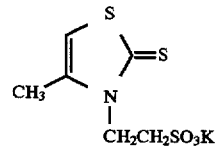

I-(3)

-continued
I-(4)
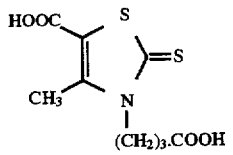
I-(5)
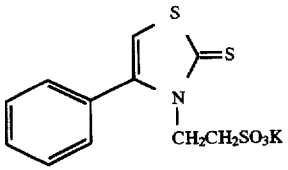
-continued
I-(6)
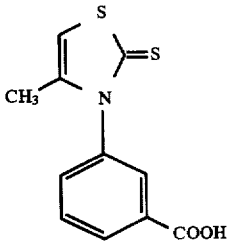
1-(7)
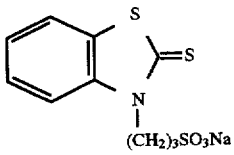
Specific examples of the compounds are set forth below.
II-(1)
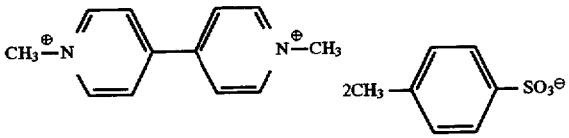
II-(2)
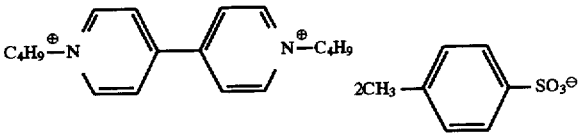
II-(3)
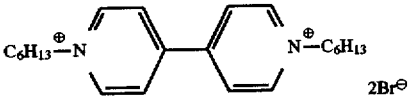
II-(4)
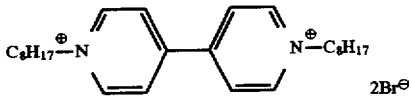
II-(5)
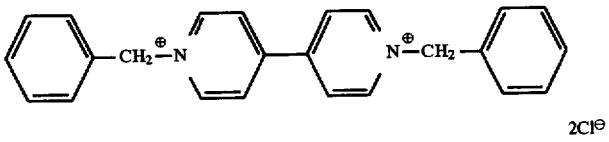
II-(6)
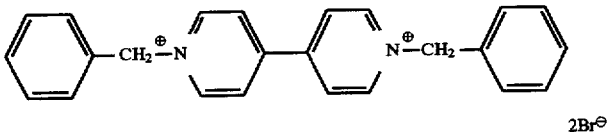
II-(7)
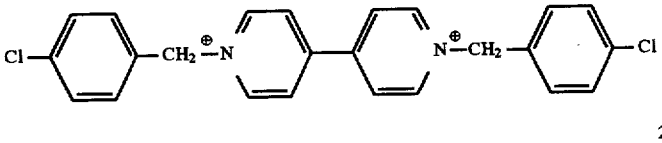

-continued

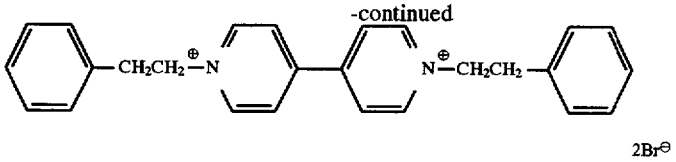

II-(8)

Specific examples of the compounds are set forth below.

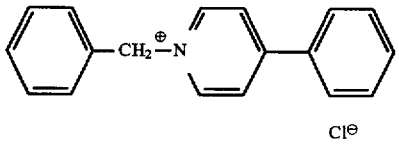

III-(1)

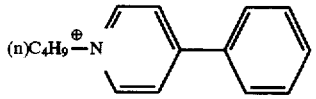

III-(2)

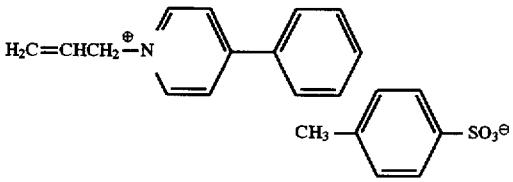

III-(3)

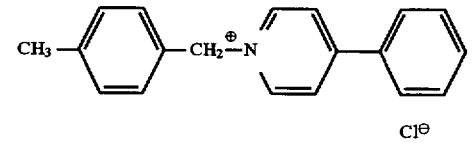

III-(4)

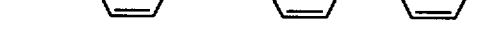

III-(5)

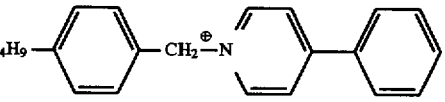

III-(6)

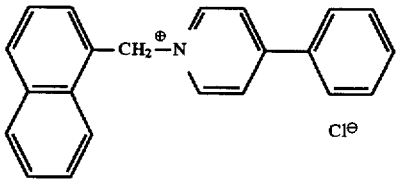

III-(7)

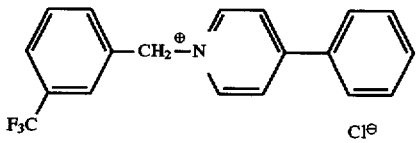

III-(8)

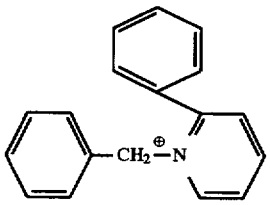

-continued

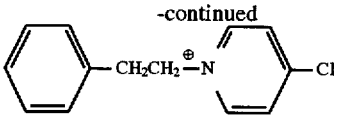

III-(9)

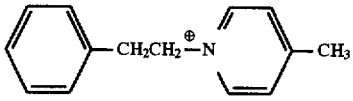

III-(10)

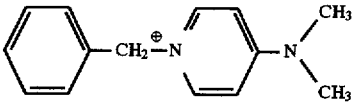

III-(11)

The high silver chloride tabular grain obtained by the method of the present invention has an aspect ratio (a ratio of the diameter of the major plane which is predominantly a (111) face, calculated in terms of a circle to the thickness of the tabular grain) of from more than 1 to 100, preferably from more than 1 to 50, more preferably from 2 to 20. The photographically suitable size as the diameter of the tabular grain may be approximately from 0.1 to 20 μm but the diameter is not restricted to this range and grains having various sizes can be prepared according to the purpose. Also, the photographically suitable thickness may be about 1 μm or less but the grain can be prepared by selecting various thicknesses according to the purpose. However, as a photographic material, the thickness is preferably from 0.01 to 1 μm, more preferably from 0.01 to 0.5 μm. The thickness as used herein means the distance between two parallel main planes-constituting the tabular grain.

The high silver chloride tabular grains of the present invention is monodispersed in the size distribution as compared with the grains obtained by conventional methods.

As described above, a silver halide solvent is preferably not used in an excessive amount at the nucleation but after the completion of nucleation, the silver halide solvent may be added. Representative examples of the silver halide solvent include a thiocyanate (see, U.S. Pat. Nos. 2,222,264, 2,448,534 and 3,320,069), a thioether compound (see, U.S. Pat. Nos. 3,271,157, 3,574,628, 3,704,130, 4,297,439 and 4,276,347), a thione compound and a thiourea compound (see, JP-A-53-144319, JP-A-53-82408, JP-A-55-77737) and an amine compound (see, JP-A-54-100717). These compounds may be variously selected and used according to the purpose. Ammonia can also be used within the range that fogging due to the increase of pH is not caused. Further, not a small number of these silver halide solvents also act as a crystal phase controlling agent capable of giving the (111) face.

In order to grow tabular grains remained after the ripening into a desired size, a silver salt solution (for example, an aqueous silver nitrate solution) and a halide solution (for example, an aqueous sodium chloride solution) may be added to the reaction solution and the addition rate, the addition amount and the addition concentration of these solutions may be increased or decreased depending upon the case. Examples of the method therefor are described in British Patent 1,335,925, U.S. Pat. Nos. 3,672,900, 3,650,757 and 4,242,445, JP-A-55-142329, JP-A-55-158124, JP-A-58-113927, JP-A-58-113928, JP-A-58-111934 and JP-A-58-111936. Further, the grain may also be grown by adding a fine grain silver halide emulsion smaller in size than the grain after ripening according to the Ostwald ripening.

The thus-prepared silver halide emulsion may be desalted and water washed by a normal flocculation method or other method such as plain sedimentation, centrifugation, ultrafiltration or isoelectric point coagulation. The desalting is commonly conducted after the grain formation but in the present invention, the desalting and water washing may be conducted at any time depending upon the purpose, for example, after the ripening but before growing.

The high silver chloride tabular grain of the present invention has a chloride content of 50% or more, preferably 65% or more, still more preferably 85% or more. The term "a chloride content of 50% or more" as used herein means that the chloride content is 50% or more to the total silver halide after the growing and the halogen composition on the way of nucleation or growing may be freely changed according to the purpose regardless of the above-described proportion.

Chemical Sensitization

Various chemical sensitizers commonly used may also be used in the present invention. A first example of the chemical sensitizer used in the chemical sensitization is a chalcogen sensitizer. The chalcogen sensitizer includes a sulfur sensitizer, a selenium sensitizer and a tellurium sensitizer and examples thereof are described below. As the sulfur sensitizer, a labile sulfur compound is used and specific examples thereof include known sulfur compounds such as thiosulfates (e.g., hypo), thioureas (e.g., diphenylthiourea, triethylthiourea, allylthiourea), allylisothiocyanate, cystine, p-toluenethiosulfonate, rhodanines and mercaptos. The addition amount of the sulfur sensitizer is sufficient if the sensitivity of the emulsion is effectively increased and although the proper addition amount varies depending upon various conditions such as pH, temperature, balance with other sensitizers and size of the silver halide grain, it is as a standard preferably from $10^{-9}$ to $10^{-1}$ mol per mol of silver halide.

In the selenium sensitization, a known labile selenium compound is used and specific examples thereof include selenide compounds such as a colloidal metal selenium, selenoureas (e.g., N,N-dimethylselenourea, N,N-diethylselenourea), selenoketones, selenoamides, aliphatic isoselenocyanates (e.g., allylisoselenocyanate), selenocarboxylic acids and esters, selenophosphates, diethylselenides and diethyldiselenides. The addition amount of the selenium sensitizer may vary depending upon various conditions similarly to the sulfur sensitizer, but it is as a standard preferably from $10^{-10}$ to $10^{-1}$ mol per mol of silver halide.

In addition to the above-described chalcogen sensitization, sensitization using a noble metal may also be conducted in the present invention. First, in the gold sensitization, the valence of the gold may be either +1 or +3 and many kinds of gold compounds may be used. Representative examples of the gold compound include chloroauric acids, potassium chloroaurate, auric trichloride, potassium aurithiocyanate, potassium iodoaurate, tetraauric acid, ammoniumaurothiocyanate, pyridyltrichlorogold, gold sulfide, gold selenide and gold telluride.

The addition amount of the gold sensitizer may varies depending upon various conditions but it is as a standard preferably from $10^{-10}$ to $10^{-1}$ mol per mol of silver halide.

The gold sensitizer may be added at the same time with sulfur sensitization, selenium sensitization or tellurium sensitization or may be added during, before or after the completion of sulfur, selenium or tellurium sensitization or the gold sensitizer may be used independently.

There is no particular limitation on the pAg and the pH of the emulsion to which the sulfur sensitization, selenium sensitization or tellurium sensitization of the present invention is applied, however, the pAg and the pH are preferably from 5 to 11 and from 3 to 10, respectively.

In the present invention, noble metals other than gold may also be used as a chemical sensitizer. Examples of the noble metal other than the gold include platinum, palladium, iridium and rhodium, and a metal salt of these or a complex salt thereof can also be used as a sensitizer.

Further, reduction sensitization may be conducted in the present invention. Examples of known reduction sensitizers which can be used in the present invention include ascorbic acids, stannous salts, amines and polyamines, hydrazine derivatives, formamidinesulfinic acids, silane compounds and borane compounds. These known compounds may be used in the present invention individually or in combination of two or more. Preferred compounds as the reduction sensitizer include stannous chloride, thiourea dioxide, dimethylamine borane, L-ascorbic acid and aminoiminomethanesulfinic acid. The addition amount of the reduction sensitizer depends upon the emulsification conditions and it should be properly selected, however, it is suitably from $10^{-9}$ to $10^{-2}$ mol per mol of the silver halide.

In addition to the method where the above-described reduction sensitizer is added, a method called silver ripening where the growing or ripening is conducted in a low pAg atmosphere at a pAg of from 1 to 7, a method called high silver ripening where the growing or ripening is conducted in a high pH atmosphere at a pH of from 8 to 11, or a method where the reduction sensitization is conducted by passing hydrogen gas or using hydrogen in a nascent state upon electrolysis may be used and two or more of these methods may also be used in combination.

The reduction sensitization may be used solely but may also be used in combination with the above-described chalcogen sensitization or noble metal sensitization.

The emulsion of the present invention may be spectrally sensitized by a methine dye or others. Examples of the dye which can be used include a cyanine dye, a merocyanine dye, a composite cyanine dye, a composite merocyanine dye, a holopolar cyanine dye, a hemicyanine dye, a styryl dye and a hemioxonol dye. Among these, particularly useful are dyes belonging to a cyanine dye, a merocyanine dye and a composite merocyanine dye. To these dyes, any nucleus commonly used for the cyanine dyes as a basic heterocyclic nucleus can be applied. Examples of the nucleus include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; a nucleus resulting from fusion of an alicyclic hydrocarbon ring to the above-described nucleus; a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may be have a substituent on the carbon atom thereof.

To the merocyanine dye or composite merocyanine dye, as a nucleus having a ketomethylene structure, a 5- or 6-membered heterocyclic nucleus such as pyrazoline-5-one nucleus, thiohydantoin nucleus, 2-thiooxazolidine-2,4-dione nucleus, thiazolidine-2,4-dione nucleus, rhodanine nucleus or thiobarbituric acid nucleus may be applied.

The dye may be added to the emulsion at any stage during preparation of emulsion. Most commonly, the dye is added in the period of from after the completion of chemical sensitization to before coating, but the dye may be added at the same time with the chemical sensitizer to effect spectral sensitization and chemical sensitization simultaneously as described in U.S. Pat. Nos. 3,628,969 and 4,225,666 or the dye may be added prior to the chemical sensitization as described in JP-A-58-113928. Also, the dyes may be added before completion of precipitation production of silver halide grains to start spectral sensitization. Further, the above-described compound may be added in installments, namely a part is added in advance of chemical sensitization and the remaining is added after the chemical sensitization as described in U.S. Pat. No. 4,225,666 and the addition time may be any stage during grain formation of silver halide as in the method described in U.S. Pat. No. 4,183,756.

The addition amount of the dye is usually from $4\times10^{-6}$ to $8\times10^{-3}$ mol per mol of silver halide.

The silver halide emulsion prepared according to the present invention may be applied to a color photographic material as well as to a black-and-white photographic material.

Examples of the color photographic material include color paper, color photographing film and color reversal film and examples of the black-and-white photographic material include X-ray film, general photographing film and film of light-sensitive material for printing.

There is no particular limitation on other additives for the photographic material to which the emulsion of the present invention is applied and those described, for example, in *Research Disclosure,* Vol. 176, Item 17643 (RD-17643), ibid., Vol. 187, Item 18716 (RD-18716) and ibid., Vol. 307, Item 307105 can be used.

The pertinent portions of RD-17643 and RD-18716 where various additives are described are summarized in the following table.

| Kinds of Additives | RD17643 | RD18716 |
|---|---|---|
| 1. Chemical sensitizer | p. 23 | p. 648, right column |
| 2. Sensitivity increasing agent | | p. 648, right column |
| 3. Spectral sensitizer, supersensitizer | pp. 23–24 | p. 648, right column–p. 649, right column |
| 4. Brightening agent | p. 24 | |
| 5. Antifoggant, stabilizer | pp. 24–25 | p. 649, right column |
| 6. Light absorbent, filter dye, IR absorbent | pp. 25–26 | p. 649, right column–p. 650, left column |
| 7. Stain inhibitor | p. 25, right column | p. 650, left to right columns |
| 8. Dye image stabilizer | p. 25 | |
| 9. Hardening agent | p. 26 | p. 651, left column |
| 10. Binder | p. 26 | p. 651, left column |
| 11. Plasticizer, lubricant | p. 27 | p. 650, right column |
| 12. Coating aid, surface active agent | pp. 26–27 | p. 650, right column |
| 13. Antistatic agent | p. 27 | p. 650, right column |

Among these additives, preferred as an antifoggant or as a stabilizer are azoles (e.g., benzothiazolium salt, nitroimidazoles, nitrobenzimidazoles, chlorobenzimidazoles, bromobenzimidazoles, nitroindazoles, benzotriazoles, aminotriazoles); mercapto compounds (e.g., mercaptothiazoles, mercaptobenzothiazoles, mercaptobenzimidazoles, mercaptothiadiazoles, mercaptotetrazoles (in particular, 1-phenyl-5-mercaptotetrazole and a derivative thereof), mercaptopyrimidines, mercaptotriazines); thioketo compounds such as oxazolinethione; azaindenes (e.g., triazaindenes, tetrazaindenes (in particular, 4-hydroxy-6-methyl(1,3,3a,7)tetrazaindene), pentazaindenes); benzenethiosulfones; benzenesulfinic acids; and benzenesulfonic acid amide.

The color coupler is preferably a nondiffusible color coupler having a hydrophobic group called a ballast group or a polymerized color coupler. The coupler may be either 4-equivalent or 2-equivalent to the silver ion. Also, a colored coupler having an effect of color correction or a coupler which releases a development inhibitor accompanying the development (so-called DIR coupler) may be added. Further, a non-coloring DIR coupling compound which produces a colorless product upon coupling reaction and releases a development inhibitor may also be added.

Examples of the magenta coupler include a 5-pyrazolone coupler, a pyrazolobenzimidazole coupler, a pyrazolotriazole coupler, a pyrazolotetrazole coupler, a cyanoacetylchroman coupler and an open-chained acylacetonitrile coupler, examples of the cyan coupler include an acylacetoamido coupler (e.g., benzoylacetanilides, pivaloylacetanilides) and examples of the cyan coupler include a naphthol coupler and a phenol coupler. As the cyan coupler, a phenolic coupler having an ethyl group at the meta-position of the phenol nucleus, a 2,5-diacylamino-substituted phenolic coupler, a phenolic coupler having a phenylureido group at the 2-position and an acylamino group at the 5-position and a coupler substituted at the 5-position of the naphthol by sulfonamido or amido are preferred in view of their excellent property in the fastness of image, which are described in U.S. Pat. Nos. 3,772,002, 2,772,162, 3,758,308, 4,126,396, 4,334,011, 4,327,173, 3,446,622, 4,333,999, 4,451,559 and 4,427,767.

Two or more kinds of the above-described couplers may be used in combination in the same layer so as to satisfy the properties required for the light-sensitive material or the same compound may of course be added to two or more different layers.

Representative examples of the discoloration inhibitor include hindered phenols such as hydroquinones, 6-hydroxychromans, 5-hydroxycoumaranes, spirochromans, p-alkoxyphenols and bisphenols, gallic acid derivatives, methylenedioxybenzenes, aminophenols, hindered amines and ether or ester derivatives resulting from silylating or alkylating the phenolic hydroxyl group of these compounds. Also, metal complexes such as a (bissalicylaldoximate) nickel complex and a (bis-N,N-dialkyldithiocarbamate) nickel complex may be used.

The photographic processing of the light-sensitive material using the emulsion of the present invention may be made by any known method and any known processing solution may be used therefor. The processing temperature is usually from 18° to 50° C. but temperatures lower than 18° C. or temperatures higher than 50° C. may also be used. According to the purpose, a development processing for forming a silver image (black-and-white photographic processing) or a color photographic processing comprising a development processing for forming a dye image may be applied.

In the black-and-white developer, known developing agents such as dihydroxybenzenes (e.g., hydroquinone), 3-pyrazolidones (e.g., 1-phenyl-3-pyrazolidone) and aminophenols (e.g., N-methyl-p-aminophenol) may be used individually or in combination.

The color developer commonly comprises an alkaline aqueous solution containing a color developing agent. As the color developing agent, known aromatic amine developing agents may be used and examples thereof include phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline).

In addition, those described in L. F. A. Mason, *Photographic Processing Chemistry*, pp. 226–229, The Focal Press (1966), U.S. Pat. Nos. 2,193,015 and 2,592,364 and JP-A-48-64993 may also be used.

The developer may contain, other than those described above, a pH buffer such as a sulfite, a carbonate, a borate or a phosphate of an alkali metal, or a development inhibitor or an antifoggant such as a bromide, an iodide or an organic antifoggant. Further, if desired, a hard-water softening agent, a preservative such as hydroxylamine, an organic solvent such as benzyl alcohol and diethylene glycol, a development accelerator such as polyethylene glycol, quaternary ammonium salt or amines, a dye-forming coupler, a competing coupler, a fogging agent such as sodium borohydride, an auxiliary developer such as 1-phenyl-3-pyrazolidone, a tackifying agent, a polycarboxylic acid-based chelating agent described in U.S. Pat. No. 4,083,723 or an antioxidant described in German Patent Application (OLS) 2,622,950 may be added.

When the color photographic processing is applied, the photographic material after the color development is usually subjected to bleaching. The bleaching may be conducted simultaneously with or independently from fixing. Examples of the bleaching agent include compounds of a polyvalent metal such as iron(III), cobalt(III), chromium(IV) or copper (II), peracids, quinones and nitroso compounds. Examples of these compounds include ferricyanide, bichromate, an organic complex salt of iron(III) or cobalt (III) (e.g., a complex salt of an aminopolycarboxylic acid such as ethylenediaminetetraacetic acid, nitrilotriacetic acid and 1,3-diamino-2-propanoltetraacetic acid or of an organic acid such as citric acid, tartaric acid or malic acid), persulfate, permanganate and nitrosophenol. Among these, particularly useful are potassium ferricyanide, sodium ethylenediaminetetraacetato ferrate (III) and ammonium ethylenediaminetetraacetato ferrate (III). The ethylenediaminetetraacetato ferrate (III) is useful either in an independent bleaching solution or in a mono-bath bleach-fixing solution.

The bleaching or bleach-fixing solution may contain a bleaching accelerator described in U.S. Pat. Nos. 3,042,520 and 3,241,966, JP-B-45-8506 and JP-B-45-8836, a thiol compounds described in JP-A-53-65732 and other various additives. After bleaching or bleach-fixing, the material may be subjected to water washing or only to processing in a stabilization bath.

The present invention will be described below in greater detail by referring to Examples, however, the present invention should not be construed as being limited thereto.

COMPARATIVE EXAMPLE 1

Figure 2:
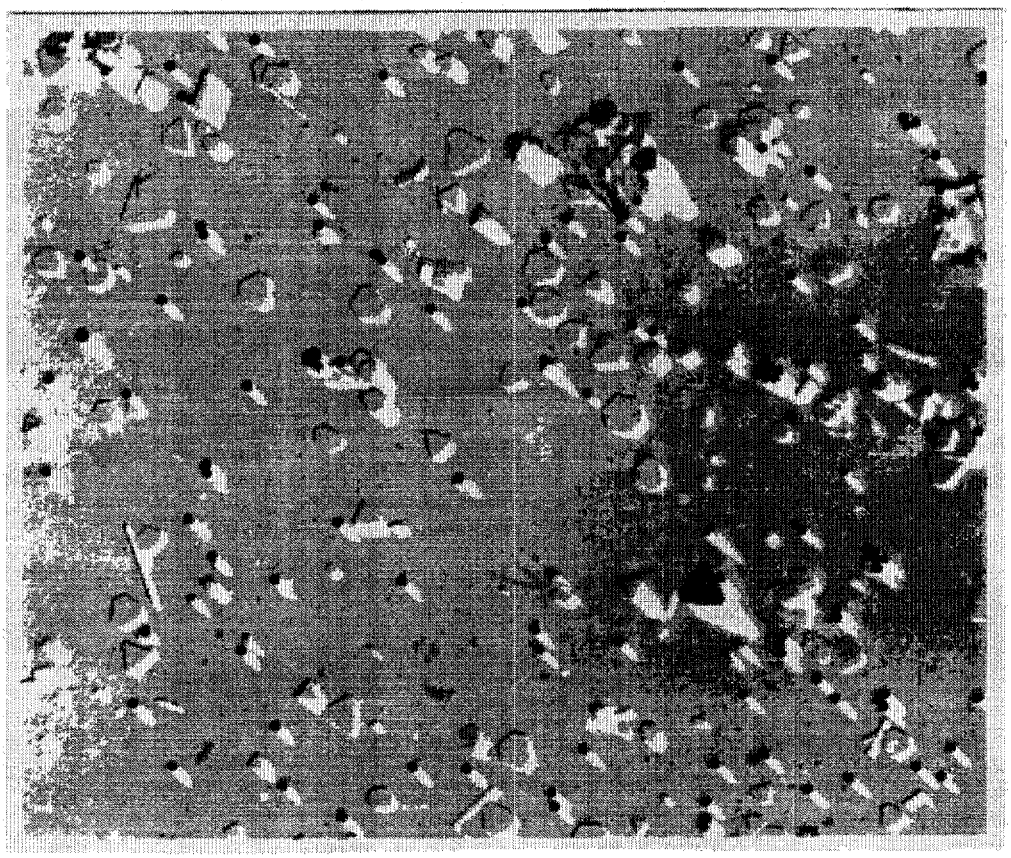
FIG. 2 is an electron microscopic replica photograph showing a grain structure of Emulsion 1 in Comparative Example 1. In the figure, black spherical particles are a latex having an average particle size of 0.5 μm used for the comparison of size (the same goes for FIG. 3 to FIG. 9).

In a reaction vessel, 1,790 ml of water, 4 g of sodium chloride and 30 g of inactive gelatin were placed and dissolved at 40° C. to obtain an aqueous solution having a pH of 5. After the complete dissolution of gelatin, the temperature of the solution was lowered while stirring to 35° C. and thereto 80 ml of an aqueous solution containing 0.02 mol/liter of Compound (A) was added, whereafter Solution A and Solution B shown below were added each at a constant flow rate of 30 ml/min over 1 minute. Then, the reaction solution was raised to 75° C. over 22 minutes and the temperature was kept. At the time when 15 minutes were spent on the way of increasing the temperature, Solution C and Solution D were added at a constant flow rate of 4 ml/min and 2.71 ml/min, respectively, over 23 minutes. After 5 minutes, Solution E and Solution F were added at a constant flow rate of 10 ml/min and 9.7 ml/min, respectively, over 40 minutes. 1 Minute after the completion of addition, sampling was conducted for the purpose of photographing grains and an electron microphotograph of a grain structure shown in FIG. 2 was obtained according to a replica method.

The black spherical subject is a latex for the comparison of size and has a size of 0.5 μm. As seen in the photograph, according to the conventional method where a crystal phase controlling agent was present before the nucleation, non-parallel twin grains occupied a large proportion and even tabular grains as an object were very polydispersed.

The emulsion of this example was designated as Emulsion 1 and the grain size determined is shown in Table 1. The grain size was determined in such a way that a latex in a size of 0.267 μm was shadowed precisely at an angle of 15° and the circle-corresponding diameter of the tabular grain and the grain thickness were accurately measured from the size of the latex and from the length of the shadow, respectively.

| | |
|---|---|
| (Composition of Solution A) | |
| Silver nitrate | 5.1 g |
| Water to make | 30 ml |
| (Composition of Solution B) | |
| Sodium chloride | 1.89 g |
| Water to make | 30 ml |
| (Composition of Solution C) | |
| Silver nitrate | 16.32 g |
| Water to make | 96 ml |
| (Composition of Solution D) | |
| Sodium chloride | 4.1 g |
| Water to make | 65 ml |
| (Composition of Solution E) | |

-continued

| | |
|---|---|
| Silver nitrate | 68 g |
| Water to make | 400 ml |
| (Composition of Solution F) | |
| Sodium chloride | 24.4 g |
| Water to make | 388 ml |
| Compound (A): | |

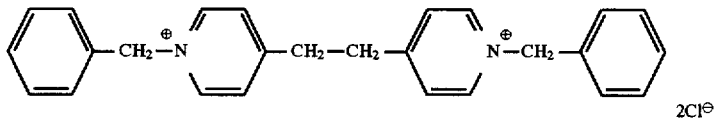

Compound No. 11 described in JP-A-2-32, page (5)

TABLE 1

Emulsion 1 (Emulsion for Comparison)

| | Size (μm) | Coefficient of Variation (%) |
|---|---|---|
| Diameter (circle-corresponding diameter of main plane) | 0.758 | 60.5 |
| Thickness | 0.151 | 49.5 |

Average aspect ratio (diameter/thickness ratio): 5.77

EXAMPLE 1

Figure 3:
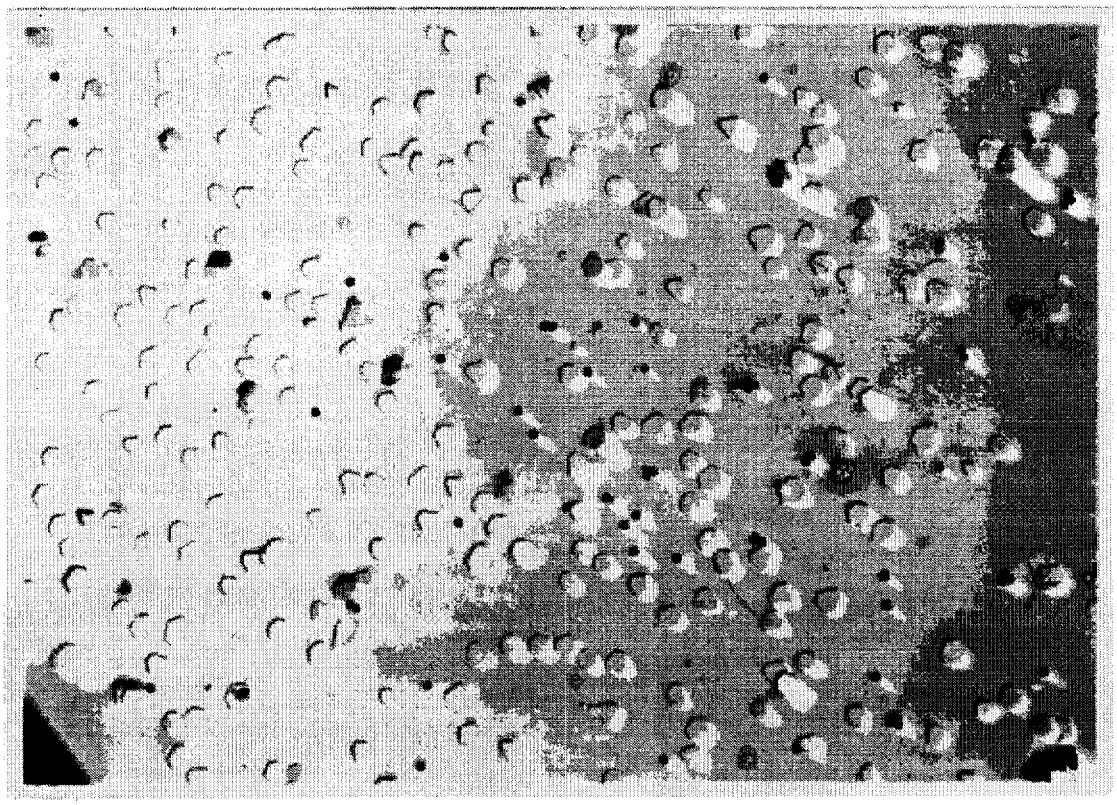
FIG. 3 is an electron microscopic replica photograph showing a grain structure of Emulsion 2 in Example 1.

In a reaction vessel, 998 ml of water, 0.4 g of sodium chloride and 1.5 g of deionized gelatin were placed and dissolved while stirring at 40° C. Thereafter, the temperature of the reaction solution was lowered to 27° C. and after the solution was stabilized, Solution A and Solution B having the compositions described below were added thereto each at a rate of 12.5 ml/min over 1 minute. 1 Minute after the completion of addition, Solution C in a solution state was added and 1 minute thereafter, the temperature was raised to 75° C. over 22 minutes. When it reached 75° C., the temperature was kept for 15 minutes to effect ripening. Then, while keeping the temperature at 75° C., Solution D and Solution E were added over about 47 minutes, where Solution D was added at an initial rate of 2 ml/min in a first-order acceleration to reach the final rate of 30 ml/min. At this time, the silver voltage was +125 mV (against a saturated calomel electrode) and controlled by a control double jet method. 8 Minutes after the completion of addition, sampling was conducted in the same manner as in Comparative Example 1 and a photograph of a grain structure shown in FIG. 3 was obtained. The emulsion of this Example was designated as Emulsion 2. As seen from FIG. 3, non-parallel twin grains were scarcely observed as compared with Emulsion 1 of Comparative Example 1 and Emulsion 2 was very monodispersed. The results of measurement on the grain size are shown in Table 2. The measurement method was the same as in Comparative Example 1.

| | |
|---|---|
| (Composition of Solution A) | |
| Silver nitrate | 7.5 g |
| Water to make | 12.5 ml |

-continued

| | |
|---|---|
| (Composition of Solution B) | |
| Sodium chloride | 2.594 g |
| Water to make | 12.5 ml |
| (Composition of Solution C) | |
| Aqueous solution containing 0.02 mol/λ of Compound (A) | 82.5 ml |
| Deionized gelatin | 23.5 g |
| Water to make | 407.5 ml |
| (Composition of Solution D) | |
| Silver nitrate | 112.5 g |
| Water to make | 750 ml |
| (Composition of Solution E) | |
| Sodium chloride | 42 g |
| Water to make | 800 ml |

TABLE 2

Emulsion 2 (Emulsion of Invention)

| | Size (μm) | Coefficient of Variation (%) |
|---|---|---|
| Diameter (circle-corresponding diameter of main plane) | 1.155 | 23.3 |
| Thickness | 0.254 | 18.6 |

Average aspect ratio (diameter/thickness ratio): 4.74

EXAMPLE 2

Figure 4:
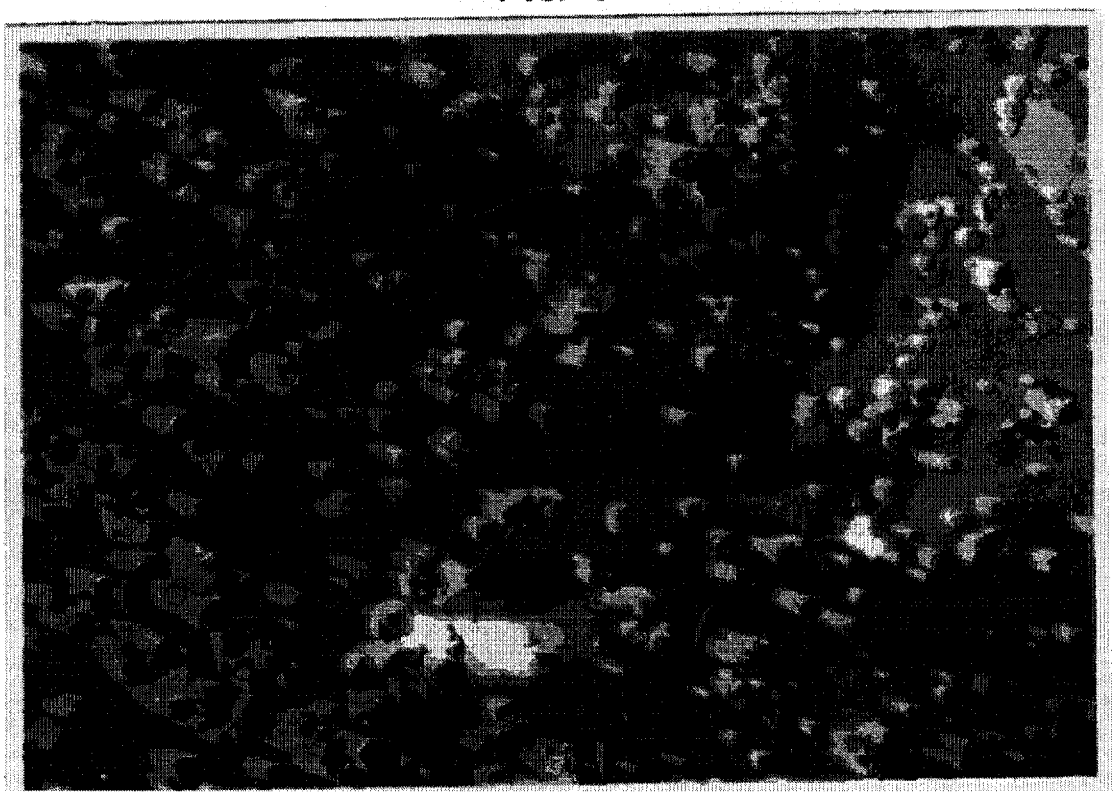
FIG. 4 is an electron microscopic replica photograph showing a grain structure obtained in Example 2.

The grain formation was conducted in the same manner as in Example 1 except that the composition of Solution C was changed as shown below and 10 minutes after the commencement of raising of the temperature to 75° C., silver nitrate and an aqueous sodium chloride solution were added for advancing the growth. A photograph of a grain structure taken through an electron microscope is shown in FIG. 4. It is seen that even when the crystal phase controlling agent was changed, the tabular grains obtained according to the method of the present invention could be low in the proportion of non-parallel twin grains. Thus, the method of the present invention is understood applicable to a large number of crystal phase controlling agents.

| (Composition of Solution C) | |
|---|---|
| Aqueous solution containing 0.02 mol/l of Compound (B) | 42 ml |
| Deionized gelatin | 23.5 g |
| Water to make | 407.5 ml |

Compound (B):

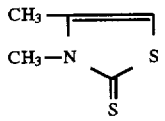

Compound No. 1-(1) described in JP-A-1-155332, page (3)

EXAMPLE 3

Figure 5:
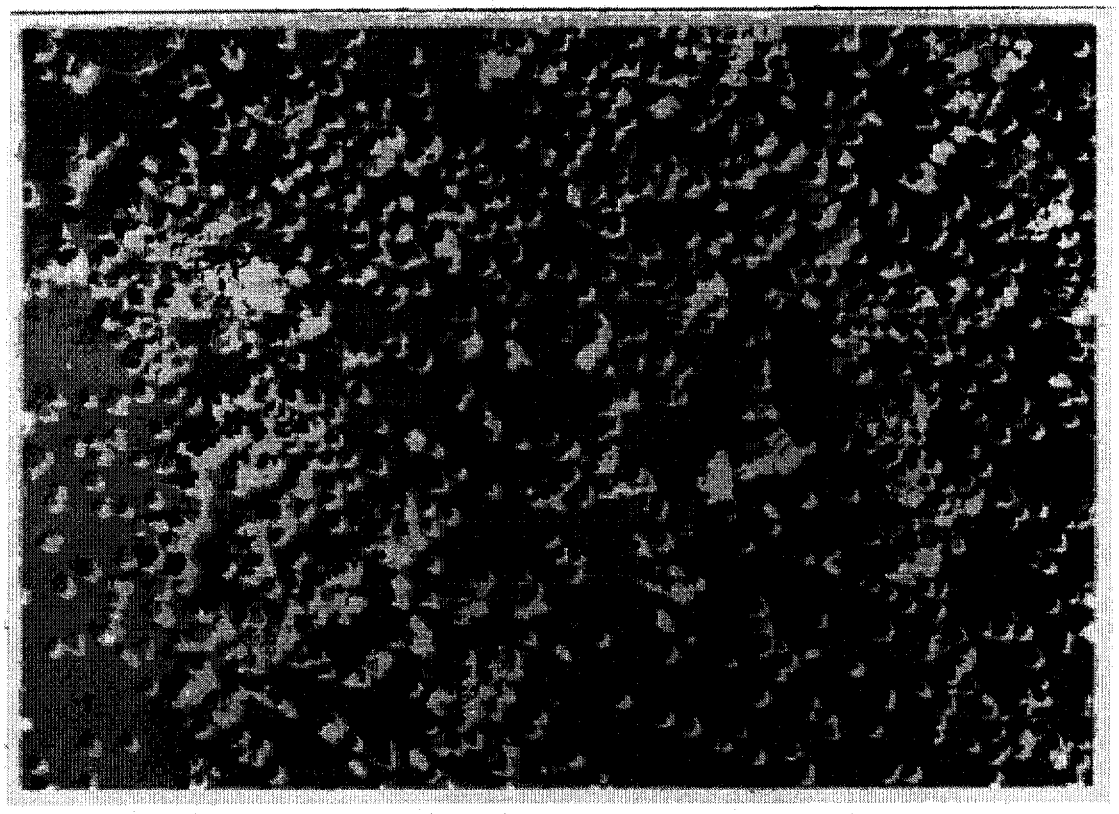
FIG. 5 is an electron microscopic replica photograph showing a grain structure obtained in Example 3.

In a reaction vessel, 2,397 ml of water, 0.96 g of sodium chloride, 3.6 g of inactive gelatin were placed and dissolved at 40° C. Then, the temperature of the reaction solution was lowered to 27° C. and after the solution was stabilized, Solution A and Solution B having the compositions shown below were added each at a rate of 30 ml/min over 1 minute. 1 Minute after the completion of addition, Solution C in a solution state was added thereto and 1 minute thereafter, the temperature was raised to 75° C. over 22 minutes. Then, ripening was conducted at 75° C. for 15 minutes. Subsequently, while keeping the temperature at 75° C., Solution D and Solution E having the compositions shown below were added over a little less than about 16 minutes, where Solution D was added at an initial rate of 1.35 ml/min in a first-order acceleration to reach the final rate of 20.4 ml/min. At this time, the silver potential was +125 mV (against a saturated calomel electrode) and controlled by a control double jet method. 8 Minutes after the completion of addition, sampling was conducted in the same manner as in Example 1 and an electron microphotograph of a grain structure shown in FIG. 5 was obtained.

| | |
|---|---|
| (Composition of Solution A) | |
| Silver nitrate | 18 g |
| Water to make | 30 ml |
| (Composition of Solution B) | |
| Sodium chloride | 6.225 g |
| Water to make | 30 ml |
| (Composition of Solution C) | |
| Aqueous solution containing 0.02 mol/λ of Compound (A) | 198 ml |
| Deionized gelatin | 56.4 |
| Water to make | 568 ml |
| (Composition of Solution D) | |
| Silver nitrate | 102 g |
| Water to make | 170 ml |
| (Composition of Solution E) | |
| Sodium chloride | 37.5 g |
| Water to make | 125 ml |

EXAMPLE 4

Figure 6:
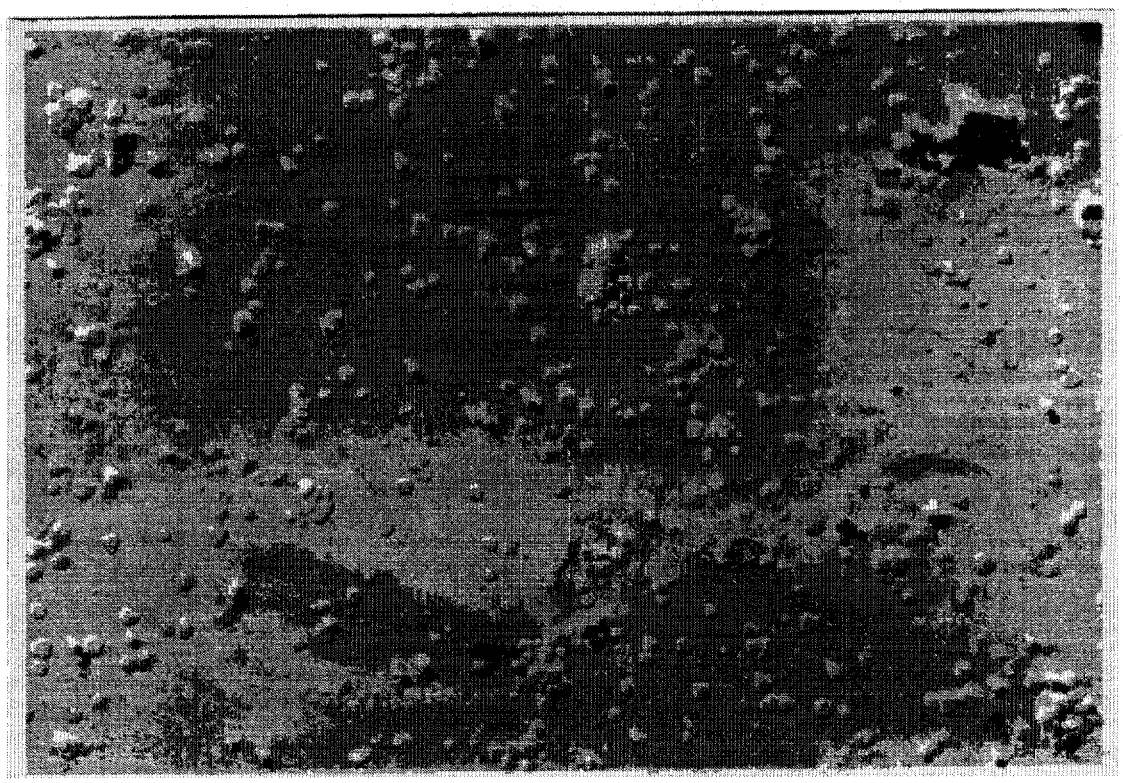
FIG. 6 is an electron microscopic replica photograph showing a grain structure obtained in Example 4.

The grain formation was conducted in the same manner as in Example 3 except for changing the crystal phase controlling agent in Solution C to Compound (C) and as a result, an electron microphotograph of a grain structure shown in FIG. 6 was obtained. It is seen that the method of the present invention could be widely applicable irrespective of the kind of the crystal phase controlling agent as long as it was a compound capable of adsorbing to the (111) face.

| (Composition of Solution C) | |
|---|---|
| Aqueous solution containing 0.02 mol/l of Compound (C) | 198 ml |
| Deionized gelatin | 56.4 g |
| Water to make | 568 ml |

Compound (C):

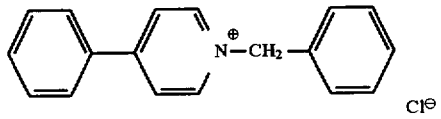

EXAMPLE 5

Figure 7:
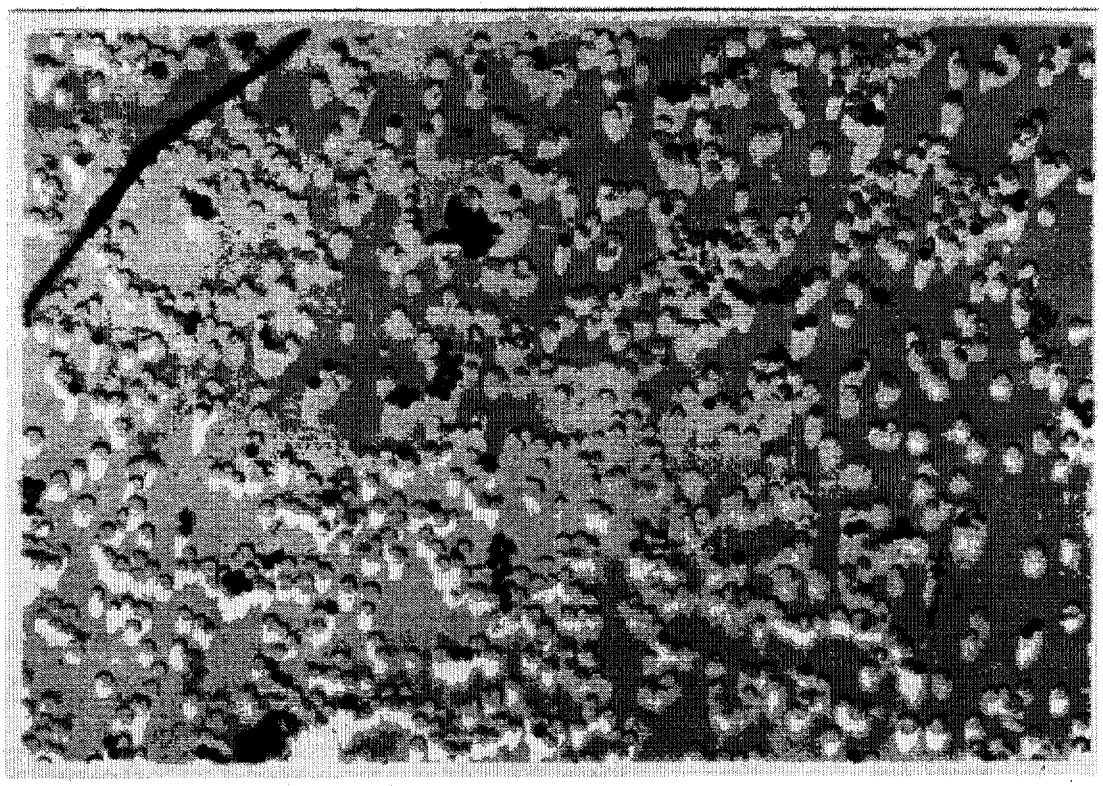
FIG. 7 is an electron microscopic replica photograph showing a grain structure obtained in Example 5.

Grains smaller in size as shown in FIG. 7 were prepared in the same manner as in Example 1 except that Solution A and Solution B were simultaneously added over 15 seconds each at a rate of 50 ml/min and 1 minute and 45 seconds after the completion of addition, Solution C was added.

EXAMPLE 6

This example proves that the grain size can be freely controlled according to the purpose only by a simple change of nucleation conditions while restraining the proportion of non-parallel twin grains and keeping the monodispersibility.

Figure 8:
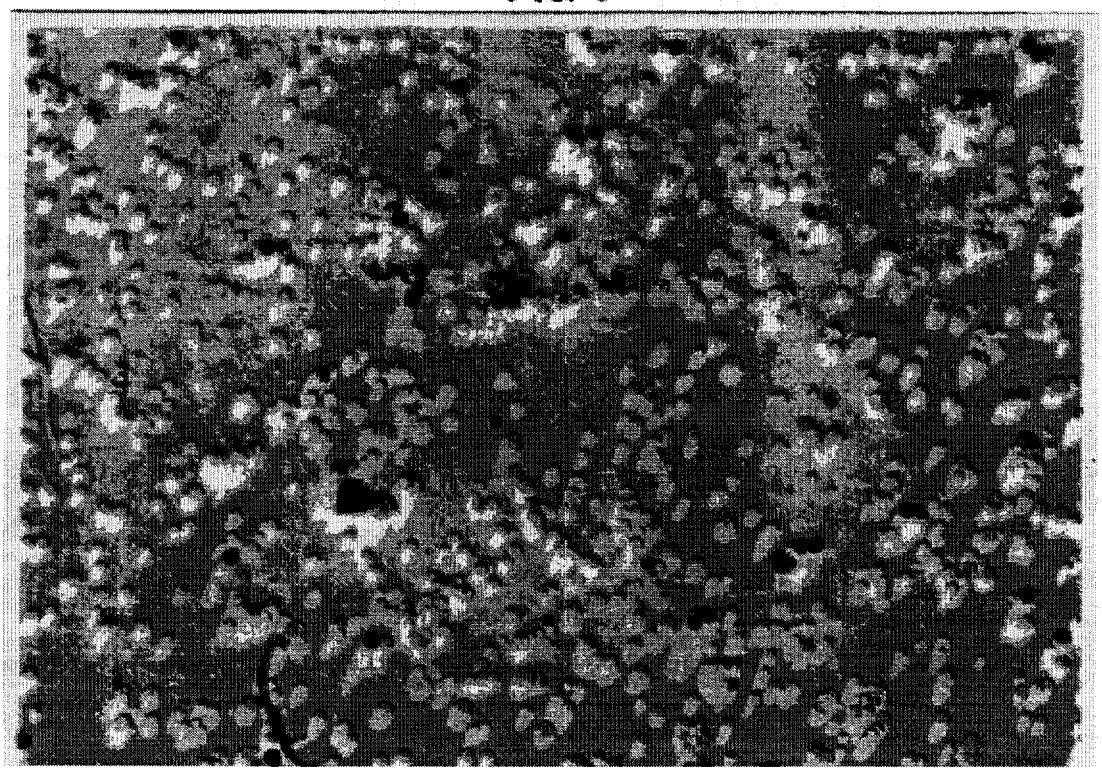
FIG. 8 is an electron microscopic replica photograph showing a grain structure obtained in Example 6.

In a reaction vessel, 2,398 ml of water, 0.96 g of sodium chloride and 3.6 g of inactive gelatin were placed and dissolved at 40° C. Then, the temperature of the reaction solution was lowered to 27° C. and after the solution was stabilized, Solution A and Solution B having the compositions shown below were added each at 120 ml/min over 15 seconds. 1 Minute and 45 seconds after the completion of addition, Solution C in a solution state was added and 1 minute thereafter, the temperature was raised to 75° C. over 22 minutes. Thereafter, ripening was effected at 75° C. for 15 minutes. Then, Solution D and Solution E having the compositions shown below were added over about 6 minutes and 30 seconds, where Solution D was added at an initial rate of 3.3 ml/min in a first-order acceleration to reach the final rate of 49 ml/min. At this time, the silver voltage was +125 mV (against a saturated calomel electrode) and controlled by a double jet method. 8 Minutes after the completion of addition, sampling was conducted in the same manner as in Example 1 and an electron microphotograph of a grain structure shown in FIG. 8 was obtained. It is seen that according to the present invention, the grain size could be freely achieved according to the purpose by a simple change in the nucleation conditions while causing no change in the scale of silver nitrate, using the same reaction vessel, keeping the very low population ratio of non-parallel twin grains and also maintaining the monodispersibility.

| | |
|---|---|
| (Composition of Solution A) | |
| Silver nitrate | 18 g |
| Water to make | 30 ml |
| (Composition of Solution B) | |
| Sodium chloride | 6.225 g |
| Water to make | 30 ml |

-continued

| | |
|---|---|
| (Composition of Solution C) | |
| Aqueous solution containing 0.02 mol/λ of Compound (A) | 198 ml |
| Deionized gelatin | 56.4 g |
| Water to make | 568 ml |
| (Composition of Solution D) | |
| Silver nitrate | 102 g |
| Water to make | 170 ml |
| (Composition of Solution E) | |
| Sodium chloride | 37.5 g |
| Water to make | 125 ml |

EXAMPLE 7

This example proves that the aspect ratio of a tabular grain can be easily changed without varying the grain volume. Usually, in a silver bromide system, the aspect ratio can be changed by the potential at growth, however, in case of a high silver chloride emulsion, the aspect ratio is controlled by the change in adsorption of a crystal phase controlling agent. The adsorption may be changed by changing the temperature, the pAg, the pH or the addition amount of the controlling agent and in this example, it is proved that the aspect ratio can be easily changed by the addition amount of the controlling agent.

Figure 9:
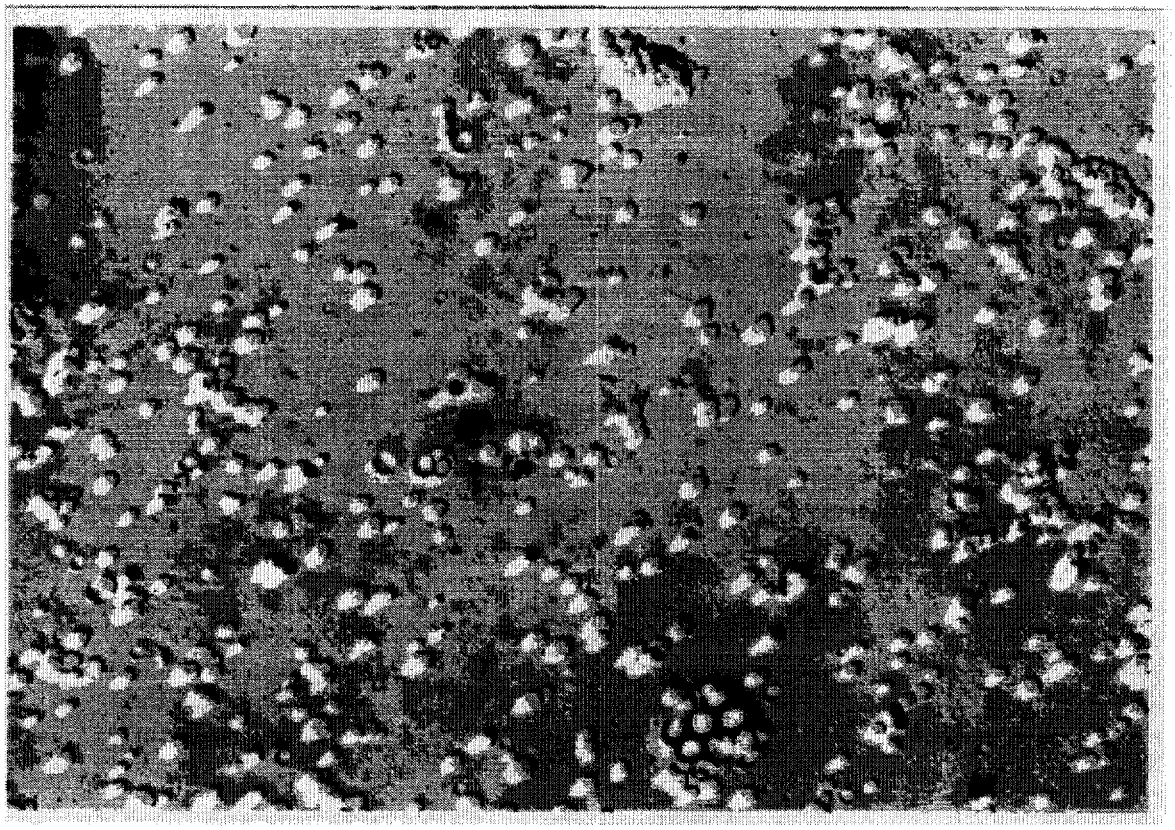
FIG. 9 is an electron microscopic replica photograph showing a grain structure obtained in Example 7.

The grain formation was conducted in the same manner as in Example 3 except that the composition of Solution C was changed as shown below. An electron microphotograph of the grain structure is shown in FIG. 9. It is seen from FIG. 9 that the aspect ratio could be freely changed according to the purpose only by changing the addition amount of the controlling agent while keeping the same grain volume. According to the conventional method where the nucleation is conducted in the presence of a crystal phase controlling agent added in advance, the crystal phase controlling agent participates in the twin crystal formation and the (111) face formation and the generation probability of twin nuclei greatly depends upon the addition amount of the controlling agent, accordingly, it is impossible to change the aspect ratio of the tabular grain without changing the number of twin grains and while keeping the grain volume as can be done in this Example. This is first achievable by the method of the present invention.

| | |
|---|---|
| (Composition of Solution C) | |
| Aqueous solution containing 0.02 mol/λ of Compound (A) | 82.5 ml |
| Deionized gelatin | 23.5 g |
| Water to make | 568 ml |

EXAMPLE 8

This example proves that the high silver chloride tabular grain of the present invention is also excellent in photographic properties.

As the crystal phase controlling agent, Compound (A) described above was used. The size of the emulsion prepared in Example 1 was controlled to give the same volume as that of Emulsion 1 in Comparative Example 1 and the resulting emulsion was designated as Emulsion 3. Further, by referring to Example 1 of JP-A-2-32, cubic and octahedral emulsions each having the same volume as that of Emulsion 3 were prepared. The resulting emulsions were designated as Emulsion 4 and Emulsion 5.

Each emulsion was desalted and water washed by a normal flocculation method and then, gelatin and water were added thereto to obtain an emulsion having a pH-of 6.3 and a pAg of 7.3. The difference in the silver or gelatin amount at the nucleation was corrected here. Then, each emulsion was subjected to optimal gold-sulfur sensitization at 75° C. using hypo and chloroauric acid and after adding thereto 4-hydroxy-6-methyl-1,3,3a,7-tetrazaindene as a stabilizer, sodium dodecylbenzenesulfonate as a coating aid, tricresyl phosphate as a hardening agent and gelatin, the emulsion was coated on a triacetyl cellulose support together with a protective layer containing 2,4-dichloro-6-hydroxy-1,3,5-triazine sodium salt and gelatin by a co-extrusion method. Thus, Samples 1, 3, 4 and 5 were obtained.

Coupler:

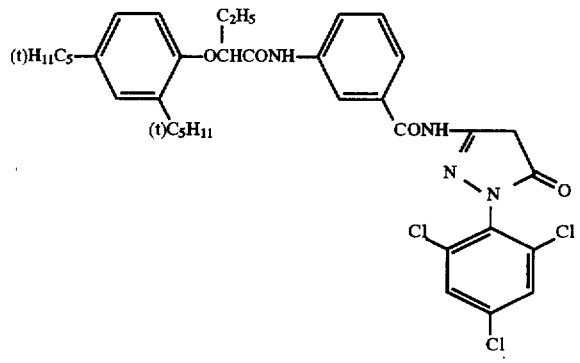

Each of these samples was exposed through an optical wedge and then processed with the following developers.

(1) CN-16 produced by Fuji Photo Film Co., Ltd.

(2) CN-20 produced by Fuji Photo Film Co., Ltd.

(3) D-76 produced by Eastman Kodak Company.

The processed samples were determined on the density (in case of color development, the measurement was conducted through a green filter) and the photographic properties obtained are shown in Table 3. The relative sensitivity is shown by a relative value of a reciprocal of an exposure amount necessary for obtaining an optical density of fog+0.2 and in the processing with CN-16, the sensitivity of Sample 3 in a development time of 3 minutes and 15 seconds, in the CP-20 processing, that of Sample 3 in 3 minutes and 30 seconds and in the D-76 processing that of Sample 3 in 7 minutes were taken as 100, respectively. As clearly seen from the results in Table 3, the tabular grain emulsion of the present invention was fast in the development progress, high in the sensitivity and very low in the fog as compared with conventional tabular grain emulsions containing many cubic, octahedral or non-parallel twin crystals and being polydispersed in size distribution, thus the superiority of the present invention was proved also with respect to the photographic properties.

While the invention has been described in detail and with reference to specific embodiments thereof, it will be apparent to one skilled in the art that various changes and modifications can be made therein without departing from the spirit and scope thereof.

What is claimed is:

1. A method for producing a silver halide emulsion comprising high silver chloride tabular grains, each having a chloride content of 50 mol % or more and a major plane comprising (111) face, said method comprising the steps of:

(i) nucleating grains in the presence of a protective colloid without a crystal phase controlling agent, having (100) faces and two twin planes parallel with each;

(ii) ripening the nucleated grains to form (111) faces with two or more parallel twin planes, by absorbing to the grains, a crystal phase controlling agent or a mixture of a crystal phase controlling agent and a protective colloid to reduce the ratio of grains other than the grains having two or more parallel twin planes; and (iii) growing the remaining tabular grains having a major plane mainly comprising a face.

2. The method for producing a silver halide emulsion as claimed in claim 1, wherein the nucleation is conducted in the absence of a crystal phase controlling agent and at an excess chlorine ion concentration of from $1\times10^{-4}$ to $8\times10^{-2}$ mol/l.

3. The method for producing a silver halide emulsion as claimed in claim 1, wherein the nucleation is conducted substantially in the absence of a silver halide solvent.

4. The method for producing a silver halide emulsion as claimed in claim 1, wherein the nucleation is conducted using from 0.05 to 8 g/l of a protective colloid.

* * * * *